US005678939A

United States Patent [19]

Ross

[11] Patent Number: 5,678,939

[45] Date of Patent: Oct. 21, 1997

[54] CARD-SHAPED, HINGED WRITING INSTRUMENT

[76] Inventor: Stuart A. Ross, 5 Oak Tree La., Irvine, Calif. 92715

[21] Appl. No.: 503,007

[22] Filed: Jul. 17, 1995

[51] Int. Cl.[6] ..... B43K 7/00; B43K 24/00; B43K 31/00

[52] U.S. Cl. ..... 401/6; 401/99; 401/192

[58] Field of Search ..... 401/99, 6, 81, 401/192

[56] References Cited

U.S. PATENT DOCUMENTS

| | | | |
|---|---|---|---|
| 659,144 | 10/1900 | Golden . | |
| 724,687 | 4/1903 | Floren . | |
| 1,669,755 | 5/1928 | Hopper . | |
| 1,977,527 | 10/1934 | Pohle . | |
| 2,748,474 | 6/1956 | Brown | 401/6 X |
| 3,373,509 | 3/1968 | Brass . | |
| 4,111,566 | 9/1978 | Kenwell . | |
| 4,217,712 | 8/1980 | Koeln . | |
| 4,269,529 | 5/1981 | McCollough . | |
| 4,421,333 | 12/1983 | Van Dyke . | |
| 4,518,273 | 5/1985 | Larizza . | |
| 4,549,827 | 10/1985 | Mack . | |
| 4,706,995 | 11/1987 | Dopp . | |
| 4,815,880 | 3/1989 | Sekiguchi | 401/6 |
| 4,872,774 | 10/1989 | Rosso . | |
| 4,883,079 | 11/1989 | Sakamaki et al. | 401/6 X |
| 4,917,517 | 4/1990 | Ertz . | |
| 5,061,104 | 10/1991 | Florjancic . | |
| 5,281,039 | 1/1994 | Hsiung et al. . | |

FOREIGN PATENT DOCUMENTS

| | | | |
|---|---|---|---|
| 122565 | 1/1919 | United Kingdom | 401/81 |

*Primary Examiner*—Steven A. Bratlie
*Attorney, Agent, or Firm*—Leonard Tachner

[57] ABSTRACT

An improved writing instrument preferably made of a clear sheet plastic material and consisting of two principal parts, namely an outer border portion which is preferably about the size of a credit card and an inner pen portion that holds an ink cartridge with a pen point projecting from the end of the pen portion. For storage and carrying, the two parts lie in the same plane, forming a card-like shape. For writing, the pen portion pivots to a comfortable angle on axle pins inserted in the card portion. The user holds the outer card portion and/or the angled pen portion while writing. Both portions are preferably of the same thickness which may be about ⅛ inch to ¼ inch, the pen portion being approximately ¾ to 1 inch wide and about 1 to 3 inches long, depending upon the overall size of the writing instrument. The card portion is connected to the pen portion by two co-axial axles or pins about 1/16 of an inch in diameter and about ¾ of an inch in length, inserted into holes in the inner sides of the card portion and in opposite sides of the pen portion so that the pen portion can pivot or rotate on the axles or pins. A compressed spring is mounted around one of the pins and is inset for part of its length in a notch cut in the card portion. On the opposite side, there is a slanted notch or slot in the card portion, the other pin running through the center of the slot. The pins are preferably placed about an inch away from the writing point of the pen piece.

11 Claims, 4 Drawing Sheets

CARD-SHAPED, HINGED WRITING INSTRUMENT

BACKGROUND OF THE INVENTION

1. Field of the Invention

The present invention relates generally to writing instruments and more specifically to a card-shaped writing instrument made, in a preferred embodiment, of clear sheet plastic comprising two main parts, namely a card portion or border member which is preferably about the size of a credit card and a pen portion or pen member that holds an ink cartridge with the pin tip projecting from an end of the pen portion. For storage or carrying, the two parts lie in the same plane, forming a card-like shape. For writing, the pen portion pivots to and is held in a comfortable angle on axle pins inserted in the card portion. The user holds the outer card portion and/or the angled pen portion while writing. The pen allows many varied hand grips, provides many options for stabilizing the pen on the writing surface and makes the writing surface around the point easily visible; so it is advantageous to persons with motor or joint disabilities such as arthritis, as well as to left-handed persons.

2. Prior Art

A search of the prior art has revealed a number of prior art writing instruments which may be relevant to the present invention to varying degrees. However, no such prior art writing instrument has all the features of the invention described and claimed herein. By way of example, none of the aforementioned prior art patents discloses a writing instrument which uses the preferred planar configuration of the present invention which provides edges and surfaces that are especially advantageous to individuals suffering from a variety of disabilities, such as arthritis, which precludes tightly gripping a conventional writing instrument. Furthermore, none of the prior art known to the applicant herein discloses the use of transparent materials to permit the user to observe through the writing instrument the results of the writing as it occurs. Furthermore, none of the prior art discovered in the aforementioned search reveals a writing instrument in which a pen member is reversibly pivoted relative to a surrounding border member and secured at an angle for the writing configuration by use of a spring and notch or slot to be disclosed hereinafter. Such a spring-biasing and slot arrangement permits the pen member to be locked into its writing configuration, thereby permitting the user to hold the border member while applying some pressure to the pen tip against the underlying writing surface, without inadvertently pivoting the pen member back into its stored configuration.

The following patents were found in the aforementioned prior art search:

| | |
|---|---|
| 659,144 | Golden |
| 724,687 | Floren |
| 1,669,755 | Hopper |
| 1,977,527 | Pohle |
| 3,373,509 | Brass |
| 4,111,566 | Kenwell |
| 4,149,812 | Huffman, Jr. |
| 4,185,933 | Zepell |
| 4,217,712 | Koeln |
| 4,269,529 | McCollough |
| 4,421,333 | Van Dyke |
| 4,508,464 | Money |
| 4,518,273 | Larizza |
| 4,549,827 | Mack |

-continued

| | |
|---|---|
| 4,706,995 | Dopp |
| 4,738,558 | Hiromori |
| 4,815,880 | Sekiguchi |
| 4,872,774 | Rosso |
| 4,917,517 | Ertz |
| 5,061,104 | Florjancic |
| 5,281,039 | Hsiung et al |

U.S. Pat. No. 4,872,774 to Rosso is directed to a writing instrument for writing and drawing. Referring to FIGS. 1 and 2, the instrument 2 provides four writing nibs 4, 6, 8, and 10 containing different colored inks. Instrument 2 comprises a main elongated body 12 of plastic material having two writing ends 12*a* and 12*b*, and the main body 12 has at each writing end, an aperture 14 or 16 through which one of the writing nibs may be projected externally from the body. The main body contains two eye-shaped slots 18, 20 in which there is rotatably mounted an auxiliary body 22, 24 (pen) in which the writing nibs forming a part of a respective refill, are inserted. Each auxiliary body (pen) has a longitudinal side wall with a recess 34 formed therein which receives a projection 36 which acts as a hinge pin, said projection 36 being borne by the inner surface of each sidewall 40, 42 of the main body 12 containing the slot 18. As a result of the coupling between projection 36 and 34, the auxiliary body is articulated in a rotary manner with respect to the main body. The inner surface of each wall 40, 42 has a projection 38, 44 which engages the sidewalls of the auxiliary body and acts as a stop member to prevent undesired rotation of said auxiliary body. Writing nibs 4, 6, 8 and 10 are enclosed in the profile of the main body as shown in FIG. 1, and in order to use the instrument, the user simply exerts pressure on one of the auxiliary bodies to cause its axial translation until the corresponding nib projects beyond the profile of the main body. After pressure has been exerted, each projection 38, 44 causes, by cooperation with the abutment surface 32 or 30, the disengagement of the pins 36, which allows the actual translation of the auxiliary body from its respective housing 34 until the stepped surface 36 reaches a position abutting against the end walls 48 and 50. The auxiliary body hinging/pivot mechanism is unlike the concept of the present invention in that pivoting is merely for changing points and writing is still accomplished in a conventional manner.

U.S. Pat. No. 5,061,104 to Florjancic is directed to a foldable flat ball point pen. Referring to FIGS. 1–5, the foldable, flat, ball point pen comprises a clasp part 1, which incorporates a receiving recess 6, and an ink cartridge holder part 2, which when not in use folds into recess 6, to form a flat, stowable, folded pen. Arms 4*a* and 4*b*, which define the receiving recess 6, are joined with each other at the opposite ends by strut 5, which also pivotally receives the ink cartridge holder part 2. FIGS. 1 and 2 show the pen in its folded, non-writing position. The folded pen is shown in its extended unfolded writing position by locking mechanism 10, which is unlike the concept of the present invention.

U.S. Pat. No. 4,217,712 to Koeln is directed to a conical pen. The Figure, the writing instrument includes a case 10 formed of a cone-shaped shell about a central axis. Case 10 may be constructed of a suitable plastic or other customary material for the fabrication of writing instruments. Of particular relevance, the material may be either opaque or transparent, or a combination of both. Located within the case is a writing mechanism 16 which may be a ball point refill mechanism of the usual type. At the cone's broad end, wall 26 may also be formed of either opaque or transparent material. In either case, it can be imprinted with desired decorative or advertising indicia. If a transparent plastic is employed for case 10, or wall 26, decorative or advertising indicia can be placed therein rather than thereon by either imprinting the interior or by inserting a sheet of paper on which the decorative or advertising indicia is imprinted. In an alternative embodiment of the invention, a transparent compartment 28 is attached to the interior of the case 10, adjacent wall 26. Compartment 28 may be utilized to display desired novelty items such as shown at 30. This pen is neither flat nor hinged and does not address the problems of the handicapped.

U.S. Pat. No. 659,144 to Golden is directed to a sash center. Referring to FIGS. 1 and 2, plate A is securely mounted to a vertical member by screws received through holes a. Pivot b fixedly engages plate A, through triangular pivot ribs d, which maintain engagement with mating plate notches c. The tension in holding spring D forces pivot b against plate A, and ribs d into mating engagement with notches c. By applying sufficient force in a direction towards cotter pin F, to overcome the stiffness of spring D, pivot b may be pulled away from plate A, thus disengaging ribs d from notches c, allowing pivot b to rotate freely through 360 degrees, relative to fixed plate A. Thus, plate A and pivot b may pivot relative to one another, only after the tension of holding spring D, which is located around the pivot shaft B and towards the outside surface of pivot b, has been overcome. The plate A and pivot b lie parallel one another.

U.S. Pat. No. 4,421,333 to Van Dyke is directed to an assembly for mounting a vehicle spray suppression device. Referring to FIGS. 2 and 3, of particular relevance is shaft means 34 in the form of elongated shaft 36 which has sleeve 32 slidably rotatable in either direction thereon, in close conforming contact with its cylindrical surface. A cam mechanism comprises projection 40 from shaft 36, a profile cam surface 42 formed in edge wall 44 of sleeve 32 of the skirt mounting means, such surface being yieldably biased into continuous interacting contact with projecting pin 40 via compression spring 46, which is compressively wedged between wall 48 of sleeve 32 and end pin 50, which is press fitted into a hole adjacent an end of shaft 36. In operation, mounting means 28 may rotate about shaft 36 only when member 28 is slid towards pin 50, thus compressing compression spring 46, and allowing projection 40 to disengage from detent 52. This hinging mechanism requires a projection 40 emanating from the pivot shaft 36, to create the locking mechanism, unlike the concept of the present invention.

U.S. Pat. No. 4,738,558 to Hiromori is directed to a writing tool comprising four levered bodies deformable into a parallelogram having at least one writing pen tip extending from an end thereof.

U.S. Pat. No. 4,815,880 to Sekiguchi relates to a card-type writing instrument with detachable writing devices mounted in a rectangular card-like casing.

From the aforementioned prior art search results, it can be seen that while some of the features of the present invention have been previously disclosed in the prior art, including by way of example, the use of a flat pen configuration, as well the pen configuration where a pivoting pen member is attached to an exterior or border member, it will also be observed that a number of highly advantageous features of the present invention are not disclosed in the prior art as will be discussed hereinafter in more detail.

SUMMARY OF THE INVENTION

The writing instrument of the present invention, in its preferred embodiment, comprises two flat pieces of transparent plastic, one inside the other in the same plane, interconnected by hinge pins or axles. A spring is mounted coaxially on one such pin. Both pieces are of approximately the same thickness, which is preferably about ⅛ of an inch to ¼ of an inch. The outer card member is about the size of a credit card which is of the size that can easily fit into one hand for writing. The card member has a section cut out to allow for the inner pen member to fit inside. The pen member is typically about an inch or less in width and about an inch to three inches in length and holds a pen or pencil cartridge having a tip which extends beyond the end of the pen member for making contact with a tablet or other surface for writing thereon.

The card member is connected to the pen member by two preferably metallic axles or pins, each about 1/16 inch in diameter and about ¾ inch in length and inserted into holes in the inner sides of the card member and the opposite sides of the pen member so that the pen member can pivot or rotate on the pins. The pins are preferably secured to either the card member or the pen member and rotatable in the other. A spring is mounted around one of the pins on one side and is inset for part of its length in a notch or slot cut in the card member. On the opposite side there is a slanted notch in the card member and the other pin runs through the center of the notch. The pins are placed about 1 inch away from the writing point of the pen member. When deployed for writing, the pen member is rotated by hand around the pins until it is aligned with the slanted notch, at which point the pen member is forced sideways by action of the compressed spring along the pin axis into the slanted notch in the card member, thereby securing it at an angle to the card member. The pins are roughly ¾ inch to 1¼ inch above the paper when the device is used for writing. An optional depression groove or other physical feature on the planar surface of the upper end of the pin member may be used to allow the user to identify in which direction the pen piece may be rotated away from the card member without looking at the pen. When writing is completed, the pen member is pushed sideways along the pins, out of the support notch and rotated back to a co-planar configuration, relative to the card member.

The ink cartridge or pencil lead cartridge is placed inside the plastic of the pen member. In the preferred embodiment shown herein, a Fisher pen cartridge refill model SUIF for example, is used as the pen cartridge because it is short and thin and thus, especially suited for use in the present invention. However, other short and thin ball point cartridges exist, and a variety of roller-ball and felt-tip cartridges could also be employed in the present invention.

The pen or writing instrument of the present invention is particularly advantageous to disabled users. It may also be attractive to regular or mainstream users who may find the following unique characteristics of the present invention to be attractive as well.

There are a variety of ways to stabilize and control the writing instrument of the present invention that do not require having to grip the pen or writing instrument tightly. Holding the writing instrument Of the present invention is a different experience from holding cylindrical pens or even flat pens of a more narrow conventional configuration. Stability in the present invention is augmented in two ways. First, it can be done by resting any side or back edge or corner on the writing surface. The smooth edge offers little resistance to the motion of the pen. Second, the writer can extend the finger tips beyond the card member or curl the fingers under the card member, to use the fingertips as supports. Downward pressure can be achieved without great grip strength by pressing down on any of the edges or the surface of the card member or even on top of the pen member, because in every case, the pressure is applied to a roughly horizontal surface or edge. The need for grip strength on a vertical surface is reduced as compared to regular pens, which require applying downward pressure on a nearly vertical surface. Directional control of the present invention is achieved by placing the fingers in any of a variety of different positions around the card member and or by holding the pen member itself at locations above or below the card member. The device permits gripping with the fingers farther apart than a regular pen or pencil and thus helps writers with limited degrees of finger motion. It thus also allows all users to use the arm muscles more than the finger muscles. Slots may be made in the exterior edges of the card member perimeter for finger grips and/or if the edges of the plastic card member are roughened or cross-hatched, the ease of gripping may be still further improved.

Another significant feature of the present invention is that it affords the writer a different view of what is being written than does holding a standard cylindrical pen. In using the present invention, the user can see through the body, through the open slot and through the pen member itself, all between or around the fingers that are held apart from one another along the outer edges of the card member. The angle between the pen member and the card member in the writing configuration, as well as the shape and size of the card member affect this visibility. The view immediately in front of the pen is slightly obstructed by the plastic material, but the view around and behind the pen point is considerably improved. This visibility around the pen makes it more attractive to left-handed persons and for drawing. For left-handed persons, the view of what has been written is greatly improved. With this pen, left-handed persons would be able to write with the left wrist behind the writing, without twisting the wrist around and ahead of the writing, because there is enough visibility of what is being written to obviate the need for twisting the wrist as is done by many left-handed writers. For drawing, the pen is an improvement over conventional pens because of the enhanced visibility, it is easier to obtain an overview of what is being done and the user is better able to focus on the whole drawing, as well as the line being drawn.

Another feature of the present invention is that the pen is flat, instead of cylindrical, in its stored configuration. It is therefore more convenient and functional to store in a shirt pocket, for example, or in a wallet or notebook pocket. No clip is required to fasten the pen of the present invention to clothing, because it will fit well in a pocket like any card would. When in a shirt pocket, it does not show above the pocket edges as most cylindrical pens do, or fall to the bottom as short pens do. Moreover, because the pen point lies within the card member surfaces in the closed condition, no cap or retraction mechanism is required.

Another significant feature of the present invention in its large, flat, plastic surfaces which are also suitable for advertising, trademarks and the like. Line drawings or simple fonts that do not interfere substantially with visibility would be most appropriate. Possible locations include the edges of the card member, the surface of the pen member or the main flat areas of the card member, particularly on the back part, furthest away from the hinge pins. The flat areas of this writing instrument provide a more readable message than do the cylindrical surfaces of conventional (i.e., polystyrene) writing instruments.

Finally, the pen of the present invention is relatively easy to manufacture because the materials are conventional and the individual components are especially adapted because of their simple shape to mass production processes, such as injection molding or machining from flat sheets of material.

As used herein, the term "pen" is used generically to mean any writing or drawing device and is not limited to devices which place ink on a surface. By way of example, the term "pen" includes herein, "pencil", "light pen", "electronic pen", "laser pointer", "thermal pen", "scoring tool" and other impression creating instruments, as well as fountain pens and other ink-type pens.

OBJECTS OF THE INVENTION

It is therefore a principal object of the present invention to provide a card-shaped writing instrument having a substantially flat planar configuration when closed and comprising a card portion having an aperture for receiving a pen portion and a co-planar pen portion substantially congruent to the aperture and mounted on a pair of co-axial axles or pins positioned in the card portion and the pen portion for pivoting rotation of the pen portion relative to the card portion. The pen portion has a pen cartridge with each pen tip extending from the pen portion at an end thereof.

It is an additional object of the present invention to provide a relatively flat writing instrument comprising a flat border member having a cut-out shape to accommodate a flat pen member rotatably secured within the cut-out by a pair of axles or pins for deployment from a flat storage position to an angular writing position by rotation or pivoting about the axles or pins. The pen member has at least one pen cartridge and a pen tip, each pen tip extending from an end of the pen member.

It is still an additional object of the present invention to provide an improved writing instrument which is preferably of a generally rectangular shape and which is adapted to lie flat in its storage configuration and having a pen portion which may be pivotally rotated relative to a border portion, the pen portion having a cartridge and pen tip extending therefrom for writing when the instrument is secured in its writing position.

It is still an additional object of the present invention to provide an improved writing instrument made virtually entirely of transparent materials whereby the writer may look through the pen as well as around the pen while writing to observe the writing created by the instrument.

It is still an additional object of the present invention to provide an improved writing instrument which is especially adapted for use by persons having finger muscle impairing handicaps, such as arthritis of the hand, as well as left-handed persons, whereby the instrument comprises a relatively wide border portion in which a pen portion is pivotally mounted. The border portion provides a relatively wide grasping area, and the entire structure provides a variety of surfaces and edges to grip, which obviate the small cylindrical grasp required of conventional writing instruments.

It is still an additional object of the present invention to provide a writing instrument with flat surfaces useful for advertising or other indicia.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
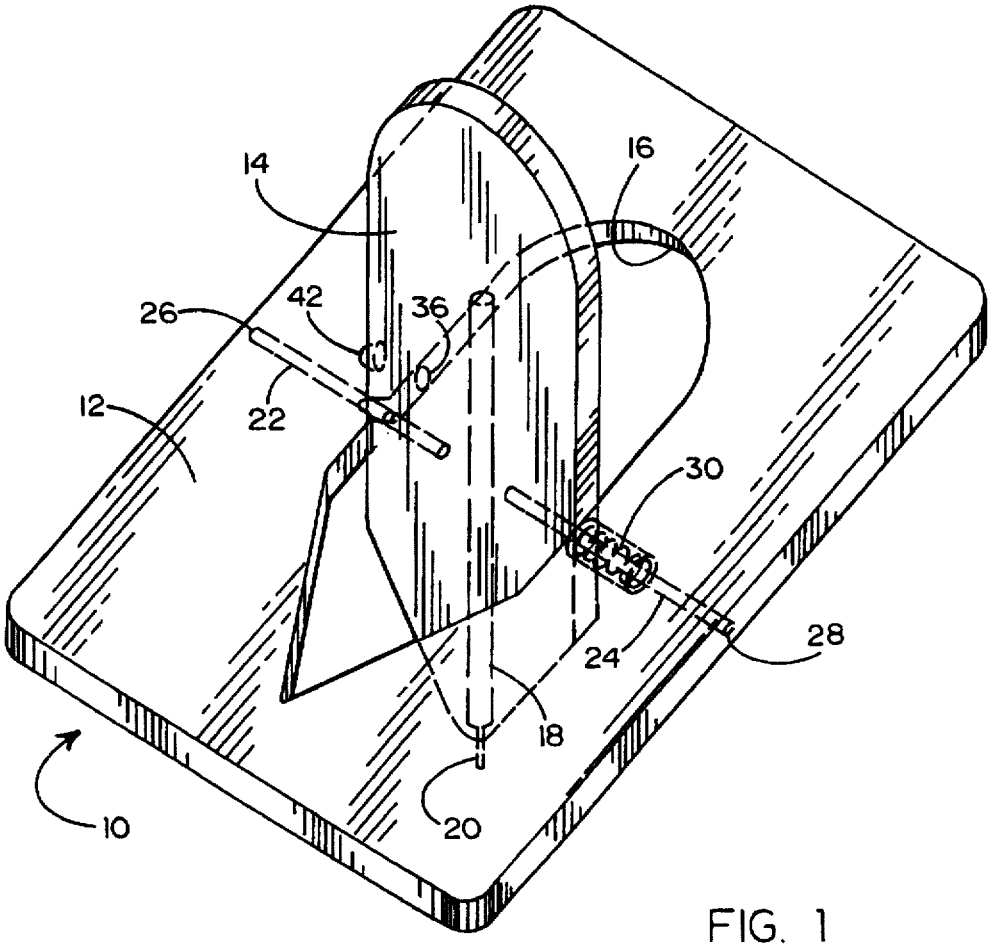
FIG. 1 is a three-dimensional view of the writing instrument of the present invention shown in its writing position.

Referring to the accompanying drawings, it will be seen that a card-shaped pen 10 comprises a card portion 12 and a pen portion 14. The card portion 12 is provided with a cut-out or pen aperture 16 which is adapted to receive the pen portion 14 in generally congruent relation. The pen portion 14 is provided with a pen cartridge 18, terminating in a pen tip 20, the latter extending beyond the end of the pen portion 14, whereby upon deployment of the pen portion as shown in FIG. 1, the tip is positioned for writing on an underlying surface. The outer edges of the card portion may be shaped or textured for ease of gripping.

It will be seen further herein that the pen portion is pivotally mounted in the card portion by a first axle or hinge pin 22 and a second axle or hinge pin 24, both positioned within a pair of co-axial passages 26 and 28 in the card portion 12 and corresponding and aligned axial passages 38 and 40 in the pen portion 14.

It will be also seen herein that one side of the aperture 16 of the card portion 12 is provided with a spring socket 32 which receives a spring 30 in a compressed mode. Spring 30 is positioned around the second axle or hinge pin 24. It will also be seen herein that the other side of the card portion 12 is provided with a retainer slot 34 and a recess 36, the latter being designed to receive with a knob 42 along the edge of the pen portion 14 for stabilizing the relationship between the card portion 12 and the pen portion 14 during the storage configuration thereof.

Figure 2:
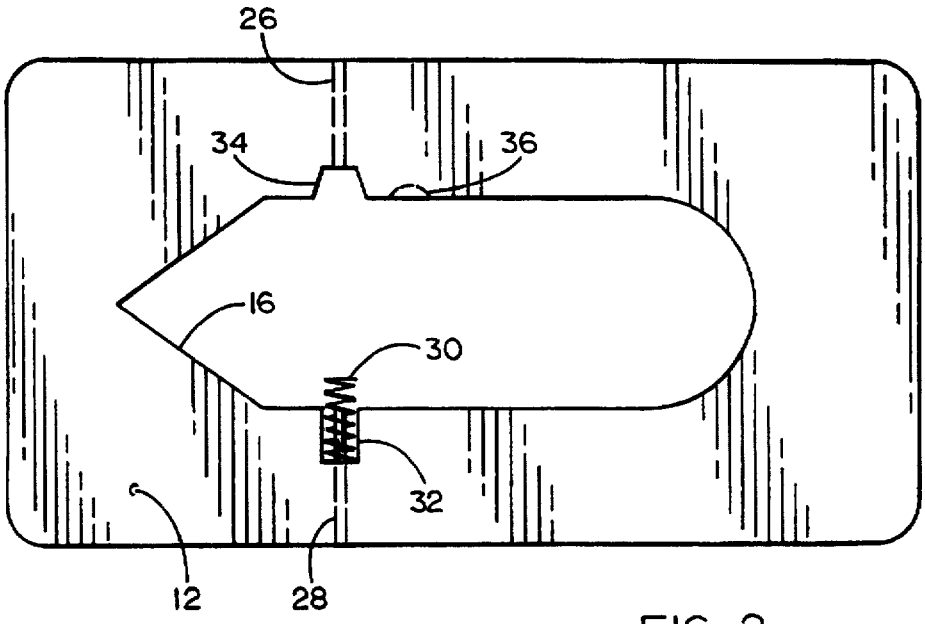
FIG. 2 is a top view of the border portion of the present invention.
Figure 3:
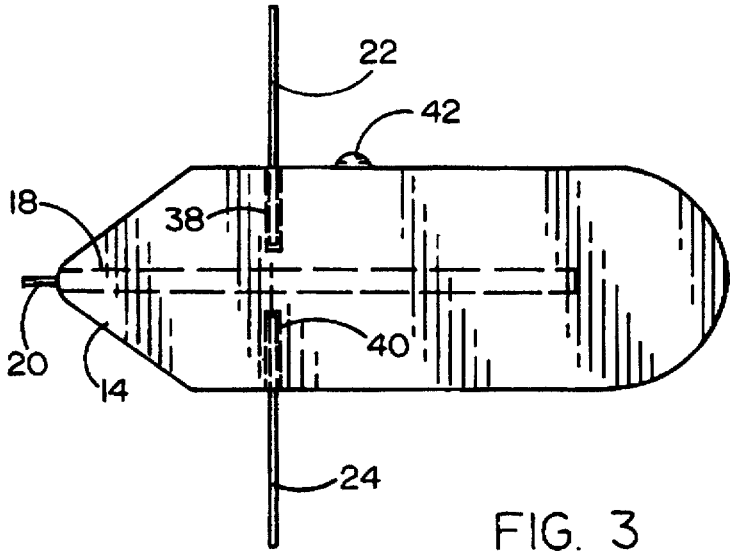
FIG. 3 is a top view of the pen portion of the present invention.
Figure 4:
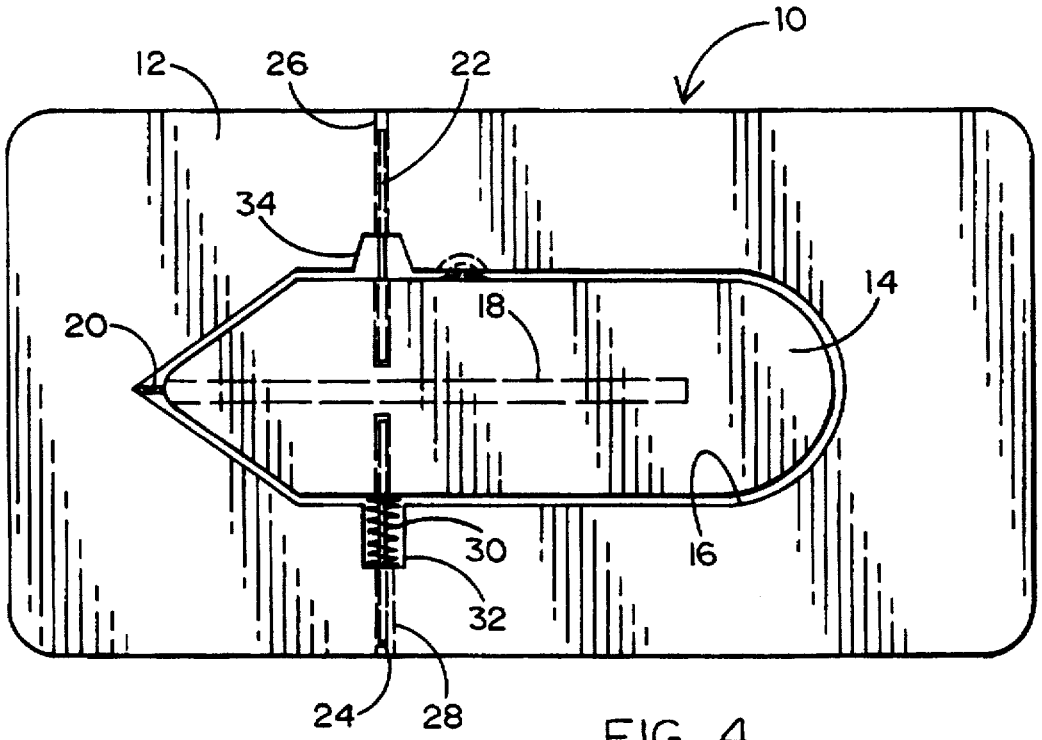
FIG. 4 is a top view of the combined border portion and pen portion of the present invention shown interconnected in a stored or non-writing configuration.
Figure 5:
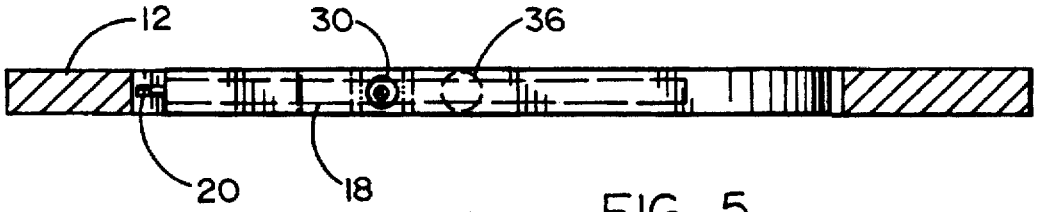
FIG. 5 is an elevational side view of the writing instrument of the invention shown in its stored configuration.
Figure 6:
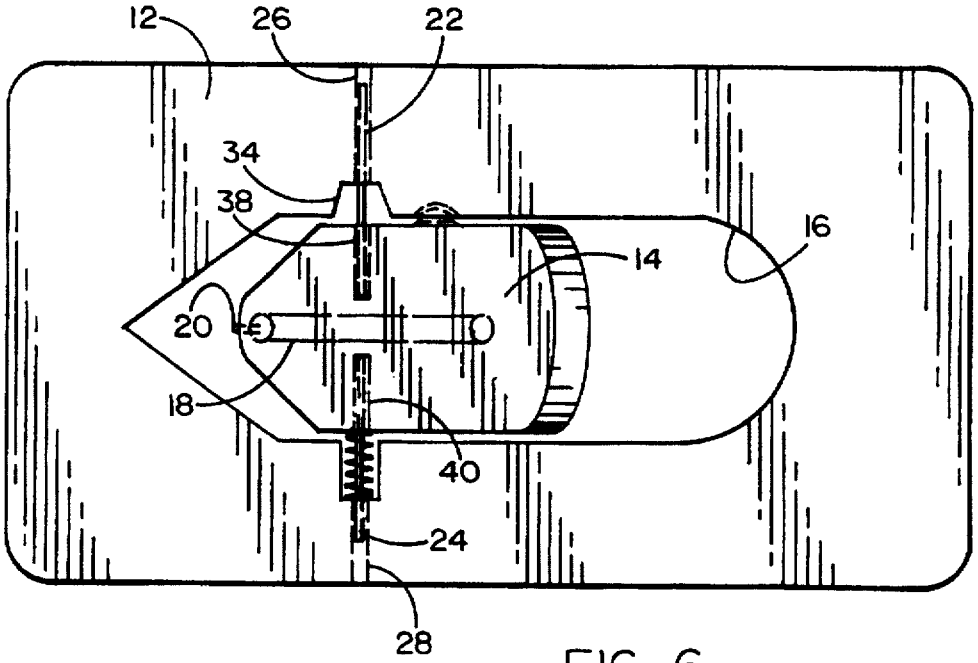
FIG. 6 is a top view of the writing instrument of the present invention shown in its writing configuration.
Figure 7:
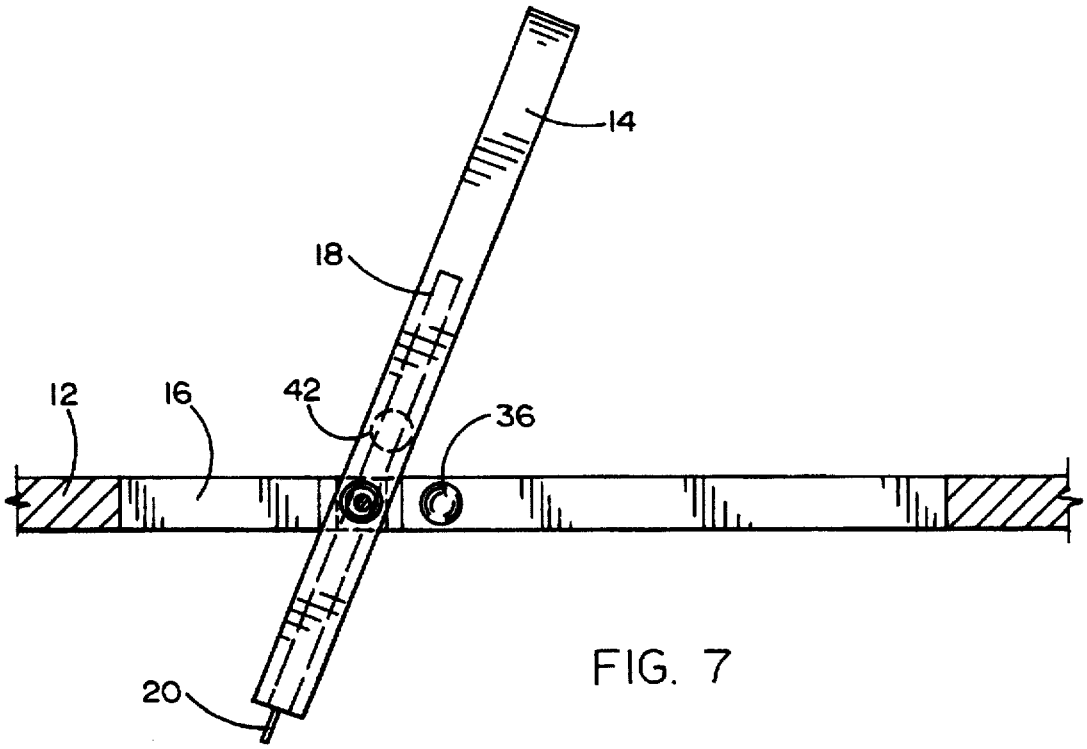
FIG. 7 is a side elevational view of the writing instrument shown in its writing configuration.
Figure 8:
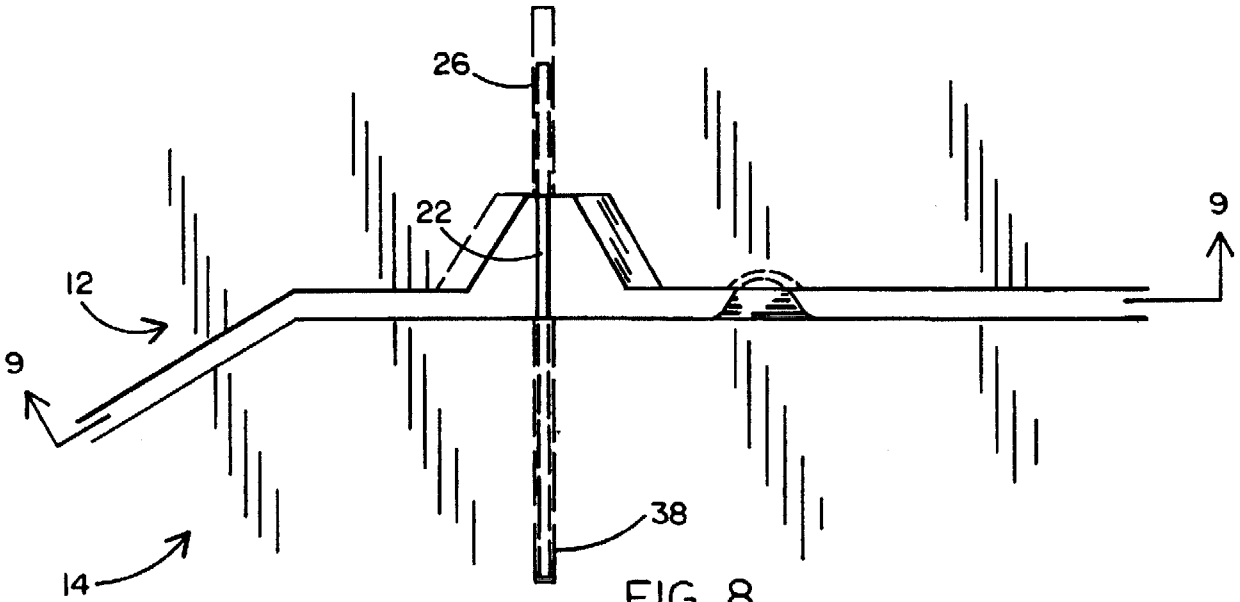
FIG. 8 is an enlarged view of the portion of the writing instrument of the present invention showing the slot for supporting the pen member in its writing position and a recess in the border portion and a knob in the pen portion for securing the instrument in its stored configuration.
Figure 9:
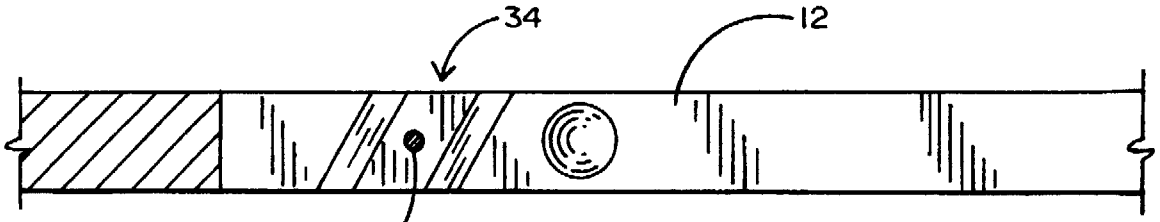
FIG. 9 is a side elevational view of that portion of the writing instrument taken along lines 9—9 of FIG. 8.

The axles or hinge pins 22 and 24 are preferably glued into passages 38 and 40 in the pen portion, as shown best in FIG. 3, but not glued into the card portion, namely into the passages 26 and 28, shown in FIG. 2. In this manner, the pen portion is free to move slightly from side to side within the aperture 16, as the pen member is being rotated from the stored position to the writing position. Such movement as seen in FIG. 6 is biased by the spring 30, pushing the pen portion toward the opposing edge of the aperture 16 until the edge of the pen portion is pushed into the retainer slot 34 with the pen portion in the writing position shown in FIG. 7 and stabilized therein so that it cannot inadvertently be pivoted back to the stored portion during the downwardly applied force used in writing. For this purpose, slot 34 narrows toward the outer perimeter of the card member. The retainer slot 34 is more fully shown in FIGS. 8 and 9, wherein it will be seen that the slot 34 is preferably a truncated and canted slot adapted to receive the edge of the pen portion 14 when that portion is in its writing position. In addition, it will be seen in FIGS. 8 and 9 that the card portion 12 is provided immediately adjacent the edge of the aperture 16 with an additional recess, namely recess 36 which is aligned with a knob 42 on the corresponding edge of the pen portion. The knob 42, the recess 36 and spring 30 cooperate when the pen portion is aligned in the same plane as the card portion in the storage position to prevent inadvertent pivoting of the pen portion which might otherwise move the pen tip 20 away from the surrounding card portion and inadvertently permit ink to contact the pocket of the user or other surface.

The card portion 12 and the pen portion 14 are both preferably made using transparent material. As previously described above, the use of a transparent material for both the pen portion and the card portion permits the writer to see through the writing instrument 10 and observe the surface upon which the writing instrument is being used to write immediately adjacent the pen tip. This unusual capability is especially advantageous for left-handed writers who otherwise have to bend their wrists considerably to observe the written effect of the application of the pen tip to the underlying surface. Artists will also find this capability useful.

Although the preferred embodiment of the invention disclosed herein has been shown with a rectangularly-shaped card portion, it will be understood that many shapes may be used for the card portion for ergonomic or aesthetic reasons. For example, heart shapes, oval shapes, triangular shapes and finger-grip shapes may also be used in lieu of the generally rectangular straight-edged surfaces shown in the accompanying figures. The only limitations would be the ease of holding the instrument and the width needed to support the pen portion and hinges. The card shape will be recognized as easily stored and carried, both during storage and writing.

It will now be understood that what has been disclosed herein comprises a novel, improved writing instrument preferably made of a clear sheet plastic material and consisting of two principal parts, namely an outer border portion which is preferably about the size of a credit card and an inner pen portion that holds an ink cartridge with a pen point projecting from the end of the pen portion. For storage and carrying, the two parts lie on the same plane, forming a card-like shape. For writing, the pen portion pivots to a comfortable angle on axle pins inserted in the card portion and is reversibly secured at that angle. The user holds the outer card portion and/or the angled pen portion while writing. The pen allows many varied hand grips, many options for stabilizing the pen on the writing surface and makes the writing surface around the writing point easily visible so that it should be attractive to persons with motor or joint disability, such as arthritis, as well as to left-handed persons who cannot ordinarily see what they are writing without turning their wrists. Because the pen is a very convenient shape when folded, it may also be attractive for the general population, including right-handed people and those not having any disabling hand problems.

In the preferred embodiment shown herein, the border portion is preferably a rectangular shape, but it will be understood that the border portion may also be of an oval shape or a triangular shape or any other shape that is suitable for holding the pen in its writing position. Both portions are preferably of the same thickness which may be about ⅛ inch to ¼ inch, the pen portion being approximately 1 inch wide and about 1 to 3 inches long, depending upon the overall size of the writing instrument. The card portion is connected to the pen portion by two axles or pins about 1/16 of an inch in diameter and about ¾ of an inch in length, inserted into holes in the inner sides of the card portion and in opposite sides of the pen portion so that the pen portion can pivot or rotate on the axles or pins. A compressed spring is mounted around one of the pins and is inset for part of its length in a notch cut in the card portion. On the opposite side, there is a slanted notch or slot in the card portion, the other pin running through the center of the slot. The pins are preferably placed about an inch away from the writing point of the pen piece.

Those having skill in the art to which the present invention pertains, will now as a result of the applicant's teaching herein, perceive various modifications and additions which may be made to the invention. By way of example, even though a single ball-point pen configuration has been shown herein, it will be readily understood that the present invention may also be suitable for use with two opposed pens as well as with other forms of writing instruments, such as pencils and felt-tip pens. Furthermore, it will be understood that the general shape of the present invention may be readily altered to accommodate a variety of different gripping preferences and that the generally rectangular configuration shown herein is disclosed only by way of ,example and is not to be considered limiting of the invention unless specifically claimed. Furthermore, it will be understood that although the two principal portions of the present invention disclosed herein are described as being transparent, it is possible to provide a writing instrument which is essentially within the scope of the general concept herein disclosed, without requiring transparency of such parts or wherein one such part is transparent and the other is opaque. Accordingly, all such modifications which may be made to the invention are deemed to be within the scope of the appended claims and their equivalents.

I claim:

1. A card-shaped writing instrument having a substantially flat planar surface and comprising:

a card portion having an aperture for receiving a pen portion;

an elongated pen portion substantially congruent to said aperture and having two ends;

a pair of co-axial axles positioned in said card portion and said pen portion between said ends for pivoting rotation of said pen portion relative to said card portion from a stored position to a writing position;

a pen cartridge in said pen portion and having a writing tip extending from said pen portion at one said end thereof;

said card portion being transparent.

2. The writing instrument recited in claim 1 wherein said pen portion is also transparent.

3. The writing instrument recited in claim 1 wherein said card portion is substantially rectangular.

4. The writing instrument recited in claim 1 wherein said card portion comprises a retainer slot in said aperture and a spring positioned coaxially around at least one of said axles for securing said pen portion in said writing position biased in said slot by said spring.

5. A flat writing instrument comprising:

a flat border member having a cutout shaped to accommodate a pen member;

a flat elongated pen member having two ends and being rotatably secured within said cutout by at least one axle positioned on said pen member between said two ends for pivoting deployment from a co-planar storage position to a non-co-planar writing position by rotation about said axle;

said pen member having a pen cartridge and pen tip, said tip extending from one said end of said pen member;

said border member being transparent.

6. The writing instrument recited in claim 5 wherein said pen member is also transparent.

7. The writing instrument recited in claim 5 wherein said border member is substantially rectangular.

8. The writing instrument recited in claim 5 wherein said border member comprises a retainer slot in said cutout and a compressed spring positioned coaxially around said axle for reversibly securing said pen member in said writing position, said spring biasing said pen member into said slot.

9. The writing instrument recited in claim 5 further comprising means for securing said pen member in said storage position.

10. A card-shaped writing instrument having a substantially flat planar surface and comprising:

a card portion having an aperture for receiving a writing portion;

an elongated writing portion substantially congruent to said aperture and having two ends;

a pair of co-axial axles positioned in said card portion and said writing portion for pivoting rotation of said writing portion relative to said card portion;

a writing cartridge in said writing portion and having a writing tip extending from said writing portion at an end thereof;

said card portion having a retainer slot in said aperture and a spring positioned coaxially around at least one of said axles for securing said writing portion in a non-planar deployed position biased in said slot by said spring.

11. A flat writing instrument comprising:

a flat border member having a cutout shaped to accommodate a writing member;

a flat elongated writing member having two ends and being rotatably secured within said cutout by at least one axle for deployment from a storage position to a writing position by rotation about said axle;

said writing member having a writing cartridge and writing tip, said tip extending from an end of said writing member;

said border member comprising a retainer slot in said cutout and a spring positioned coaxially around said axle for securing said writing member in said writing position, said spring biasing said writing member into said slot.

* * * * *